United States Patent [19]

Armond

[11] Patent Number: 4,591,943

[45] Date of Patent: May 27, 1986

[54] APPARATUS FOR DEMAGNETIZING A CHUCK

[75] Inventor: Joseph A. Armond, River Forest, Ill.

[73] Assignee: Electro-Matic Products Co., Chicago, Ill.

[21] Appl. No.: 498,568

[22] Filed: May 26, 1983

[51] Int. Cl.[4] ..... H01F 13/00

[52] U.S. Cl. ..... 361/145

[58] Field of Search ..... 361/145, 144

[56] References Cited

U.S. PATENT DOCUMENTS 3,368,119 2/1968 Littwin ..... 361/145

4,370,693 1/1983 McDonald et al. ..... 361/145

*Primary Examiner*—J. R. Scott

*Assistant Examiner*—Hong K. Choe

*Attorney, Agent, or Firm*—Paul H. Gallagher

[57] ABSTRACT

Apparatus for controlling the magnetizing and demagnetizing of the chuck in a machine tool, and the workpieces held thereon. A plurality of individual chucks are incorporated in the machine tool, and they are selectively brought into circuit according to the characteristics of workpieces. The demagnetizing phase is controlled as to length of overall period and the number of reversing steps in that period.

4 Claims, 9 Drawing Figures

Fig. 1.
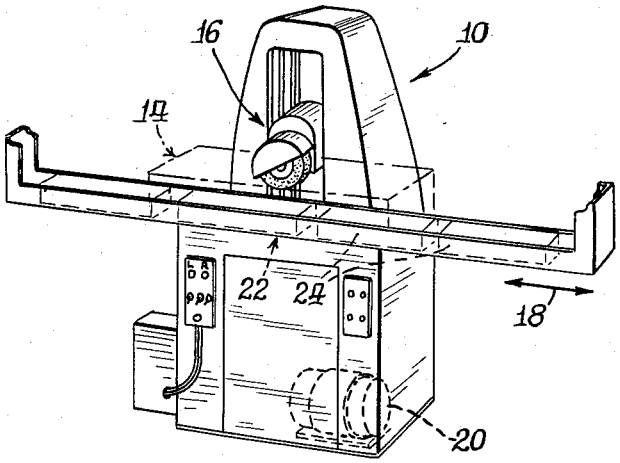
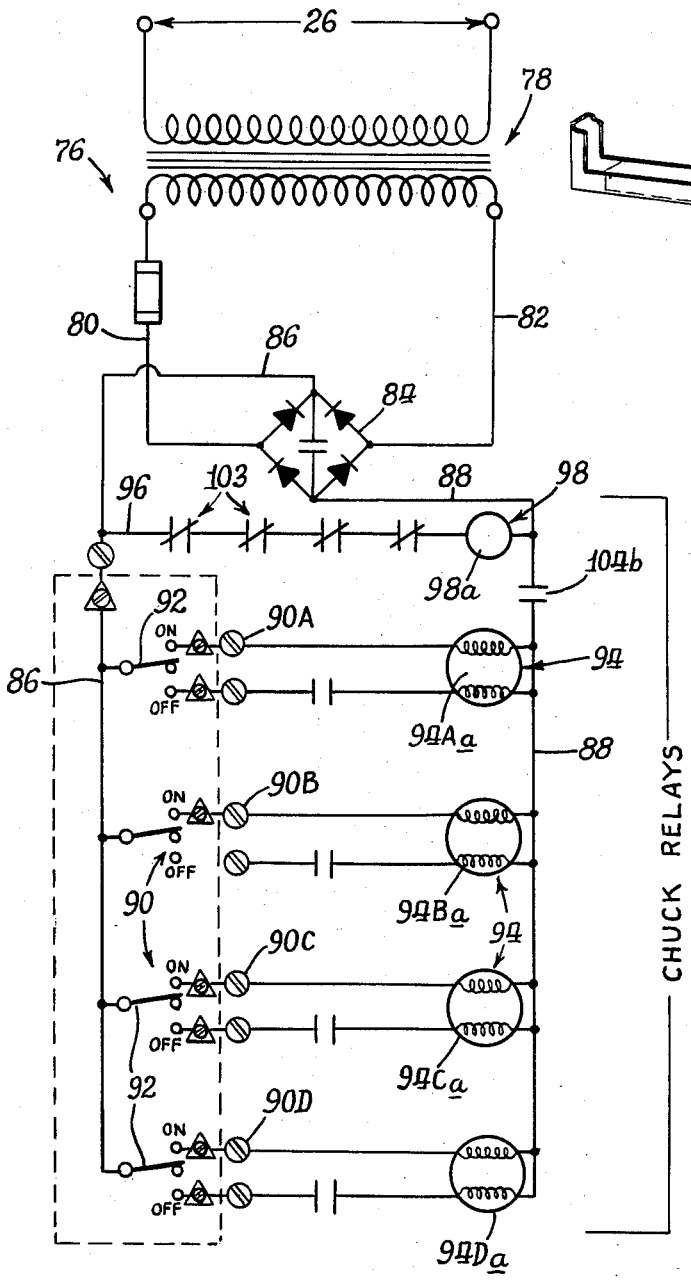
Fig. 8.
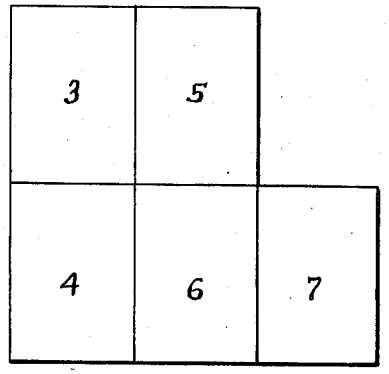
Fig. 2.

26
L1
L2
27
2P
1P
20V.
208V.
22V
150V
35V
45V
34
40V
240V
280V
34S
R
98b
110
R
36
RELEASE
126S
RELEASE
124S
38
40
42
44
44
ON
120S
ON
122S
36
46
44
44
46

TERMINAL CODE

- △ RESISTOR TERMINAL
- ⊘ CONTROL & OUTPUT TERMINAL
- ▣ MODULE TERMINAL
- ◬ REMOTE CONTROL TERMINAL
- ⬡ A.C. TAP TERMINAL
- ○ TRANSFORMER TERMINAL
- □ EC773T STAGE TERMINAL
- ⊗ A.C. LINE TERMINAL

APPARATUS FOR DEMAGNETIZING A CHUCK

FIELD OF THE INVENTION

The invention resides in the field of demagnetizing and particularly an industrial phase thereof. For example, in the case of a grinder, the workpiece to be ground is placed on the chuck in the grinder, and held thereon by magnetism. When the grinding operation is completed, the holding magnet is shut off, but the residual magnetism in the chuck and the workpiece is so great as to render it impossible to remove the workpiece if the chuck and workpiece are not demagnetized, and to remove that residual magnetism, they are therefore so demagnetized.

OBJECTS OF THE INVENTION

A broad object of the invention is to provide novel apparatus and method for demagnetizing, of the foregoing general character, having the following features and advantages.

1. A plurality of individual chucks, or chuck units, are incorporated in the apparatus, and selectively included in circuit, in each operation, according to the characteristics of the workpieces being demagnetized.

2. Means is provided for selectively varying the damagnetizing cycle according to the characteristics of the workpieces and the number of chucks utilized in the cycle.

3. Novel safety means is provided for manually interrupting operation of the apparatus in the event a defect should occur in the apparatus or in the machine to which it is applied.

BRIEF DESCRIPTION OF THE DRAWINGS

In the drawings,

FIG. 1 is a perspective view of a grinder embodying the chuck of the present invention;

FIG. 2 is a diagram showing the portions of FIGS. 3–7, constituting the electrical circuit, in the positions they occupy therein;

FIG. 8 is a portion of the electrical circuit; and

DESCRIPTION OF A PREFERRED EMBODIMENT

Referring in detail to the drawings, FIG. 1 shows a grinder 10, which is one example of device to which the demagnetizer of the present invention is applied. The grinder itself may be conventional and includes a reciprocating table 12 on which the workpieces are placed for grinding them. A workpiece is indicated at 14 and is ground by a grinder head 16, pursuant to reciprocation of the table, in directions indicated by the double headed arrow 18. The table is reciprocated and the grinder operated by suitable means indicated at 20.

Figure 3:
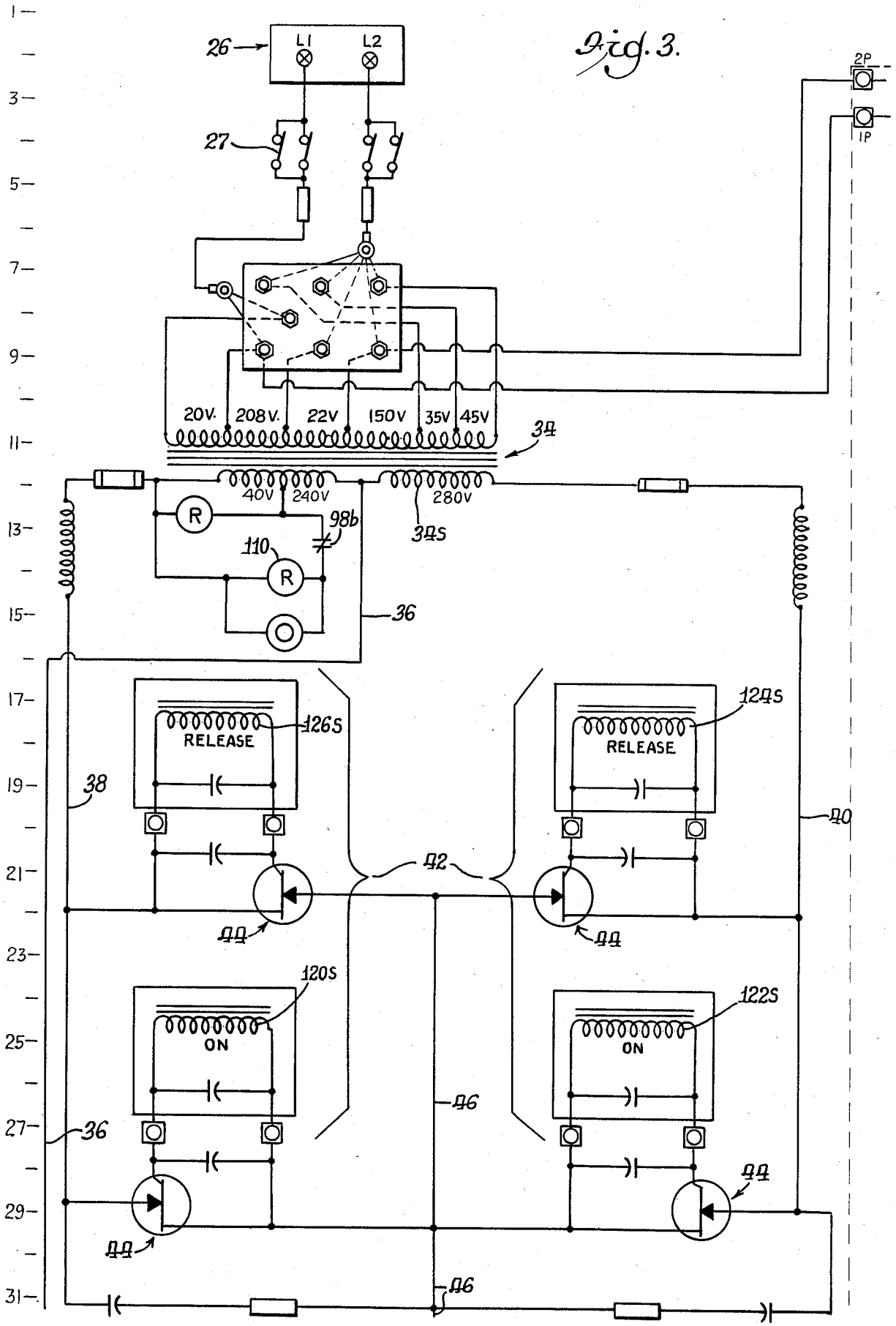
FIG. 3 is a portion of the electrical circuit.
Figure 4:
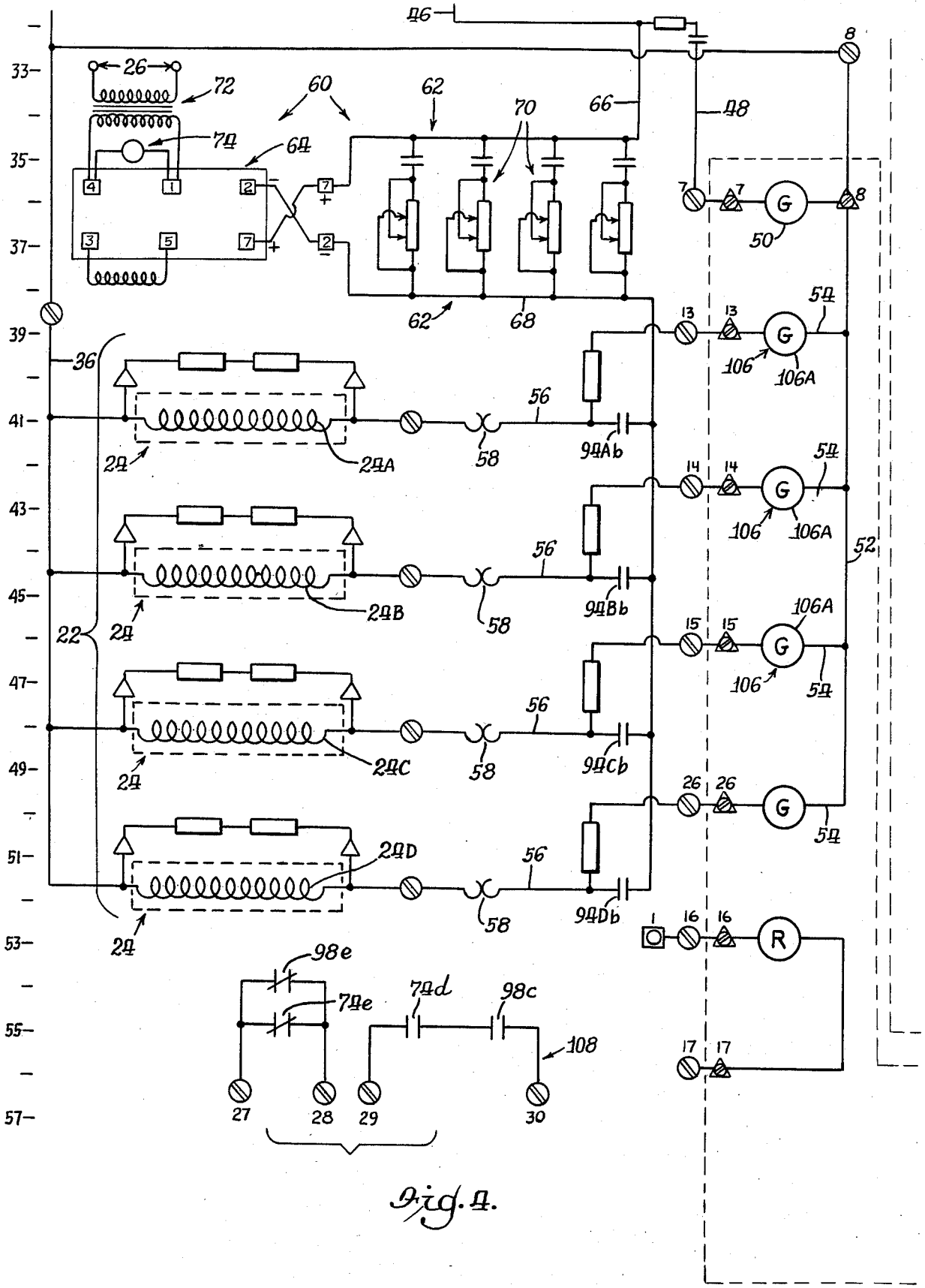
FIG. 4 is a portion of the electrical circuit.

FIG. 1 shows chuck means 22 incorporated in the reciprocating table 18, which is utilized for holding the workpieces 14 thereon. The chuck means 22 includes a plurality of individual chucks 24 which, together with the means for controlling them, constitutes a principal feature of the invention. The individual chucks are identified in FIG. 4 as 24A, 24B, 24C, and 24D, respectively. In the present instance, the apparatus includes four individual chucks, although the number may be less than that or more than that, and in the example of four individual chucks, there is a like number of other elements cooperating therewith such as four resistors, four relays, etc.

In the electrical circuitry of FIGS. 3–8, the diagrams are provided with line numbers at the left margins thereof to facilitate designating the locations of the various elements referred to, these line numbers being given in parenthesis following the references to the corresponding elements in the description thereof.

Figures 5, 9:
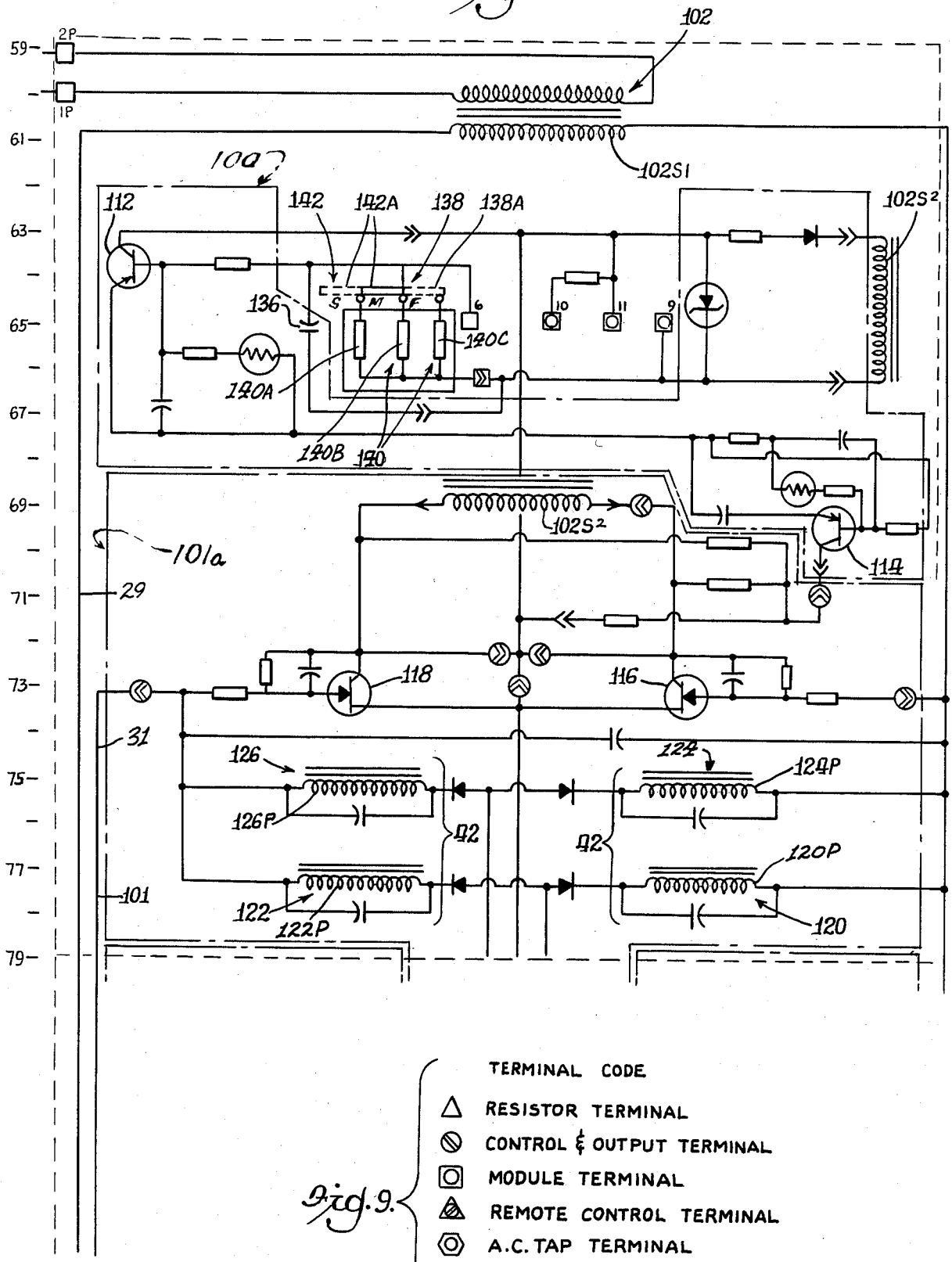
FIG. 5 is a portion of the electrical circuit.
FIG. 9 is a legend showing the terminal code of the electrical circuit.

Referring in detail to the electrical circuit, the chuck means 22 is shown at (46); the circuit is connected with a suitable AC source 26 (1), having a main line switch 27 (4) and a manually actuated remote control ON-OFF switch 28 (108), and conductors 21, 31 lead from the terminals #1, #3, of the switch 28 into the circuit portion of FIG. 5. Upon manual actuation of this latter switch, the apparatus is selectively placed in condition for holding the workpiece on the table, and demagnetizing the apparatus. The electrical circuit also includes other manually actuated switches 30, 32 (108) which are usually incorporated in demagnetizing apparatus, but which do not specifically enter into the novel features of the present apparatus.

In the following detail description, the transformers are identified by simple reference numerals, the primaries thereof by the same reference numeral and the postscript P, and the secondaries with the same reference numeral and the postscript S with additional numerals to indicate individual ones. Similarly, relays are identified by simple reference numerals, the coils thereof by the same reference numerals and the postscript a and the contacts thereof by the same reference numerals and the postscripts b, c, d, etc.

Connected with the AC source 26 (1) is a transformer 34 (11) leading from the secondary of which is a center tap common conductor 36 (15) leading to the individual chucks 24 (47). Leading from the terminals of the secondary 34S (12) are conductors 38, 40 (19) leading to a set of secondaries of transformer means indicated as a whole at 42 (20, 76), which will be referred to in detail hereinbelow. Associated with the secondaries of the transformer means 42 are SCR's 44 respectively, and from the secondaries leads a common conductor 46 (27) leading to the chuck means opposite the conductor 36 (27). The conductor 46 includes a branch 48 (34) leading to a pilot light 50 then to a common conductor 52 (43) from which branches 54 (40) lead to respective ones of the individual chucks 24. The conductors 54 include green signal lights 106 (40) and these conductors lead to respective conductors 56 (43) which lead directly to the individual chucks. In the conductors 56 are thermal overload switches 58.

Associated with the chuck means 22 is an interstage safety unit 60 (33) including components 62, 64. The component 62 includes a conductor 66 leading from the common conductor 46 (32) and parallel with the conductor 48. This component also includes a conductor 68 (38) leading to the conductors 56 which in turn lead to the individual chucks. Connected across the conductors 66, 68 are a plurality of parallel adjustable resistors 70. The component 64 (35) includes a transformer 72 the primary of which leads from the main source 26 and, connected with the component 62 through terminals #2 and #7, has electrical means of known kind, becoming energized when the current passing through the resistors 70 is at a predetermined level, and when so energized, energizing a relay 74 (35), but when the current through any one or more of those resistors drops below that level, the component 64 becomes de-energized, and the relay 74 correspondingly de-energized. The function of this relay 74 will be referred to again hereinbelow.

The sub-circuit of FIG. 8 is utilized for predetermining the number of individual chucks, and which chucks, are connected in the main circuit of the apparatus. At this point, it is explained that in the use of the apparatus, its primary purpose is demagnetizing, but in order to perform the demagnetizing operation, it must control the original magnetizing. As stated above, the chuck means is magnetized for holding the workpieces on the table of the grinder, and after the grinding operation is performed, the chuck means is turned off, but it retains residual magnetism, and to eliminate this residual magnetism, the chuck means is put through a demagnetizing cycle, and this apparatus is then turned from a first attitude in which it magnetizes, to a second attitude in which it demagnetizes. Also as noted above, the various ones of the individual chucks desired to be used in a particular operation, are selected at the beginning of the operation, and then the operation is put into effect, i.e. the grinding operation, but the number of chucks that has been selected remain so selected and that number cannot be changed during the course of the grinding operation or the following demagnetizing operation.

The sub-circuit of FIG. 8, identified 76, includes a transformer 78 connected with the main source 26. Leading from the secondary 78S are conductors 80, 82, which lead to a rectifier 84, and leading from the rectifier are conductors 86, 88 and connected across these conductors are individual control means 90, individually identified 90A, 90B, 90C, 90D. Each control 90, includes a manual switch 92 and a latch relay 94. Also connected across the conductors 86, 88 is a conductor 96 which includes a relay 98 and thermal relay contacts 103 respectively controlled by the thermal overload relays 58 (41).

Figure 6:
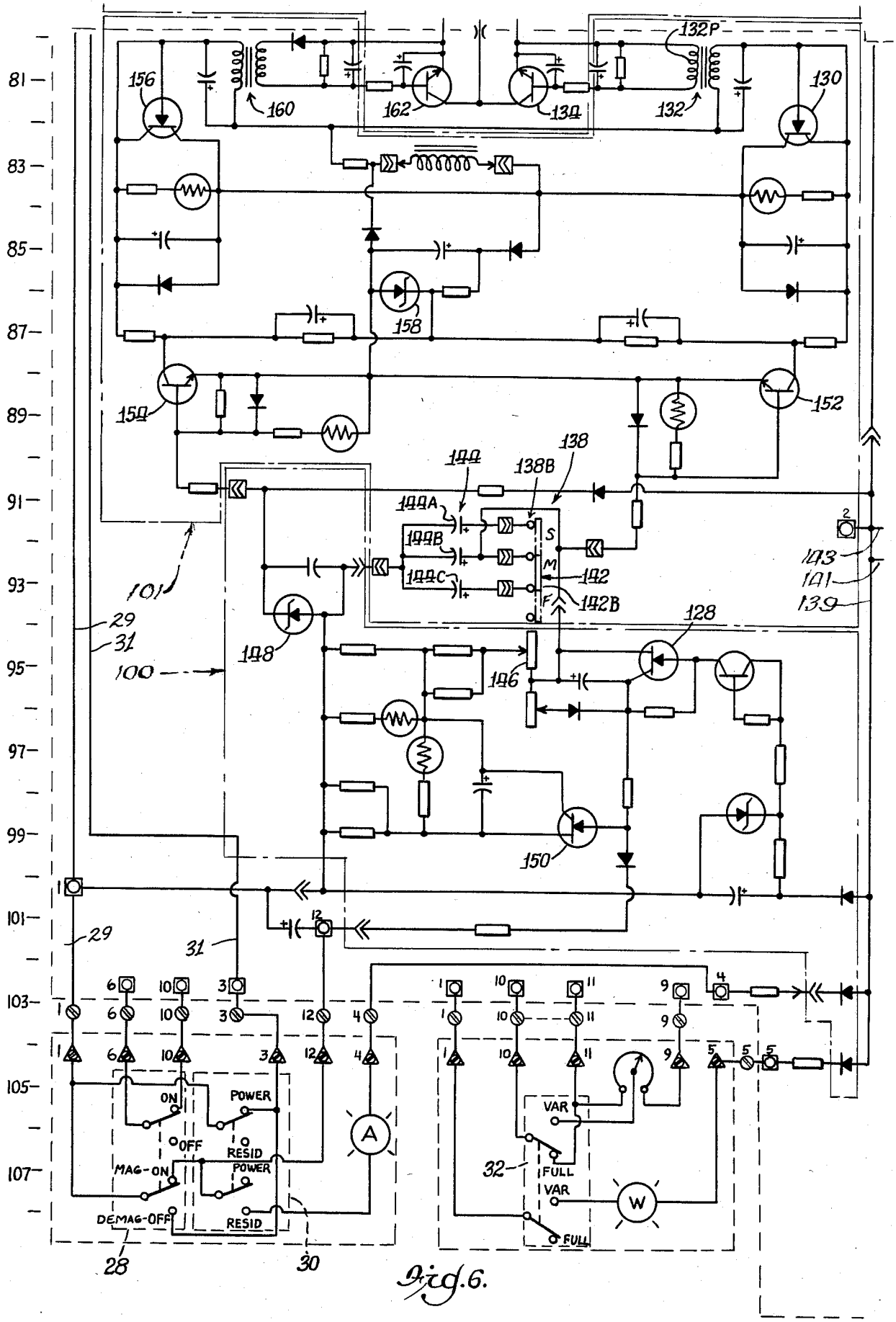
FIG. 6 is a portion of the electrical circuit.

Reference is next made to the circuit portions of FIGS. 5 and 6. In setting up the apparatus for use, such as the first use of the day, the main line switch 27 (4) is turned on which energizes the apparatus for certain purposes including the selection of the chucks desired. In this condition, the main transformer 34 (11) is energized, as well as transformer 78 (FIG. 8) and transformer 102 (60).

A safety feature is provided, in the circuit, as thus far described. If a certain maximum current is exceeded, the grinder is stopped through the contacts **98*c* (55), and upon the current dropping below a certain minimum, the grinder is stopped through the contacts 74*d* (55**).

The circuit means of FIGS. 5 and 6 include certain components referred to at this point for convenience, including an oscillator unit 100 (shown in two parts) (62, 95), an amplifier unit 101 (93) and a polarity reversing unit 101A (707).

Detail description of the circuit and its operation is included hereinbelow, but it is stated that when the remote control switch 28 (108) is in OFF position the relay 104 (112) is energized, and the contacts **104*b* (FIG. 8) are closed, putting the conductors 86, 88 in circuit. At this point, the magnetizing/demagnetizing components are inactive, and the chucks are in unmagnetized condition, and thereupon the operator actuates the switches 90 (FIG. 8) for energizing the respective latch relays 94 for placing the individual chucks 24 (47) in circuit, thus closing the contacts 94A*b* (41), etc., and placing the respective individual chucks in circuit. As noted above, these individual chucks are selected as desired and may be any or all of them, and need be in no particular number of grouping. Upon closing the contacts 94A*b* etc., the corresponding signal lights 106 (40**) are lighted.

The contacts 103 (FIG. 8) related to the thermal overload relays 58, are normally closed, energizing the relay 98 (FIG. 8). The relay 98 includes the contacts **98*c* (55) mentioned above in a subcircuit 108 incorporated in the grinder and so long as the contacts 98*c* are closed pursuant to the sub-circuit 76 (FIG. 8) being energized, the grinder is permitted to operate under other controls, but upon de-energization of that relay 98, the grinder is stopped. The relay 98 also includes normally closed contacts 98*b* (13) and when de-energized, those contacts close, turning ON a RED signal light 110 (14**).

Figure 7:
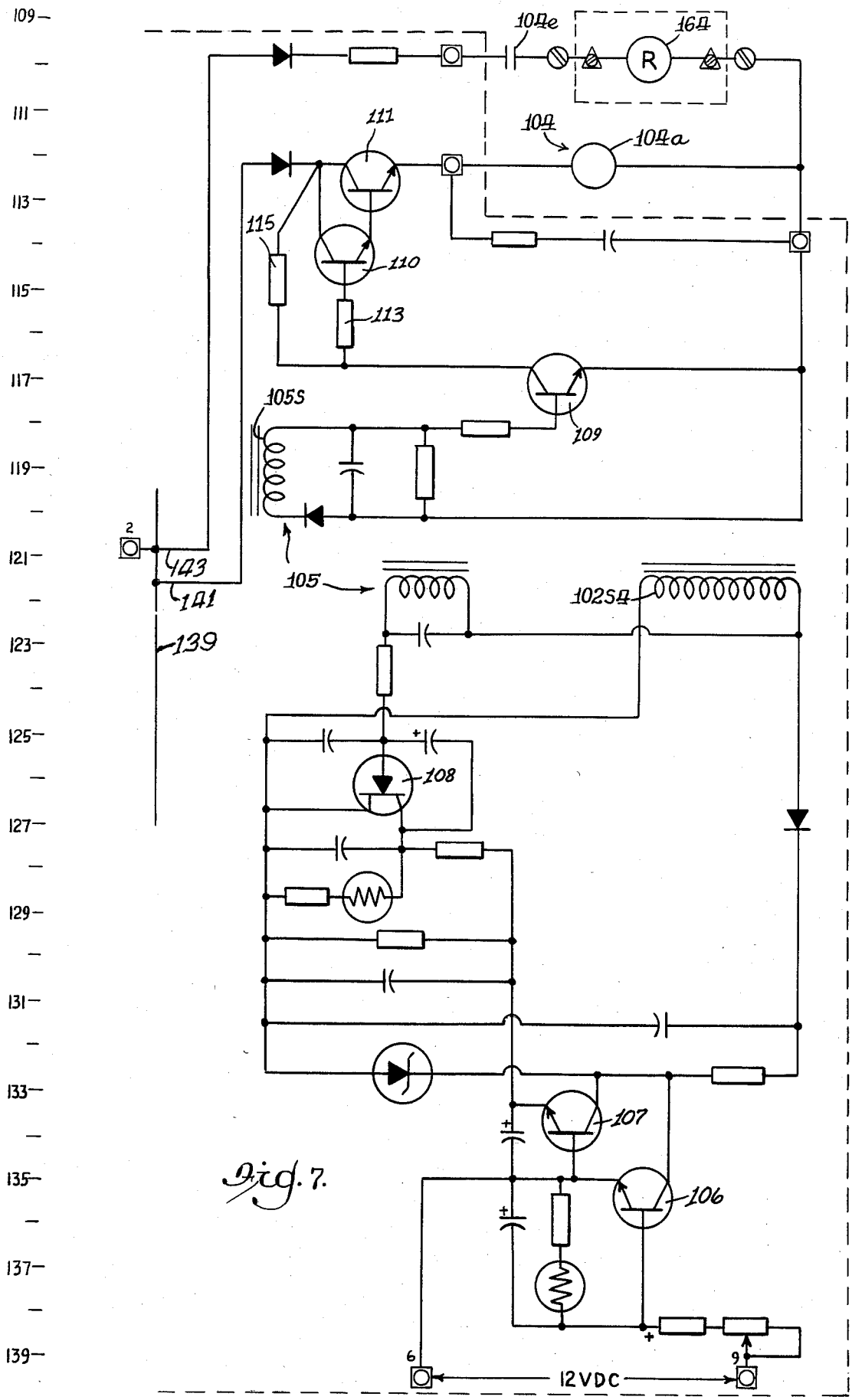
FIG. 7 is a portion of the electrical circuit.

Following is a description of the overall circuit, and includes specific reference to the portion of FIG. 7, particularly in conjunction with the terminals #6 and #9 and how they are controlled by the switches 28, 32 (107). At this step, the switch 32 is in FULL position placing 12 volts DC across those terminals, derived from the secondary 102S2 (63), this energization of the secondary being referred to hereinbelow. The voltage on those terminals produces a forward bias on a transistor 106 turning it ON, which turns on transistor 107. The transistor 107 when turned ON, triggers SCR 108 which energizes the primary of the transformer 105. The voltage from the secondary thereof, 105S, turns ON transistor 109 which supplies negative voltage to transistors 110, 111 and holds them OFF. In this condition the relay 104 is deenergized. This also puts the capacitor 136 (65) in circuit for charging, as indicated above.

The circuit through the terminals #6, #9 includes terminal #10 (103, two positions).

In the demagnetizing operation, the switch 28 (108) is thrown to OFF position and therefore the terminals #6, #9 are opened and the voltage across these terminals, as examplified in the capacitor 136 (65), slowly decays, and this decay takes part in the demagnetizing step, as referred to again hereinbelow. As this voltage decays, transistor 106 (136) will shut OFF, this shutting OFF the other transistors 107 (134) and 108 (126), and consequently transistors 109 (117). This then will turn ON transistors 110 (115) and 111 (112) by means of positive voltage from the resistors 113, 115 (116).

In the operation of the apparatus, after the beginning steps of closing the main line switch 27 (4) and selecting the individual chucks to be used, the workpieces are placed on the table of the grinder. At this point, the terminals #6 and #9 are open (103), (104), enabling the condenser 136 (65) to be otherwise charged and the relay 104 (112) is energized through the transformer 105 (121). Then the operator moves the remote control switch 28 (108) to ON position, opening terminals #6 and #9 (140) and enabling the relay 104 (112) to be energized. This also shorts terminals #6 and #10 (65) and those terminals apply potential to the base of transistor 112 (64) turning it ON, energizing transistor 114 (69), and with that transistor turned ON, full potential is applied to SCR's 116, 118 (73) turning those SCR's ON. Consequently, full voltage of 115 V. is applied across the interstage transformer means 42 (20, 76), at different steps and in different conditions. This transformer means includes a first set of primaries 120, 122 (78), arranged in series and constituting the specific transformer means for energizing the chuck means in its holding condition. These same transformers are utilized in the demagnetizing step in conjunction with transformers 124, 126 (75) also arranged in series, and coming into action as explained hereinbelow.

Also upon turning the switch 28 (108) to ON position, it shorts the terminals #1 and #12 (103) and this turns ON the oscillator unit 100 (62, 95). In this step, gate voltage is applied to SCR 128 (94) and when this is energized, a voltage is applied to SCR 130 (82), energizing the latter, and thereby voltage is applied across the primary 132P (80), and the secondary thereof applies a gate voltage to transistor 134 (82), which then energizes the primaries mentioned, namely 120P, 122P (77). It is to be noted that the accompanying primaries 124P, 126P (75) at this step do not become energized, because the primaries 120P, 122P are utilized to energize the chuck means and hold the workpieces in place, but in the demagnetizing step, both sets of transformers 120–122, 124–126 become alternately energized for producing the desired reversed demagnetizing steps. Upon energization of the primaries 120P–122P, 124P–126P, the energization of the secondaries (FIG. 3) energize the chuck means.

At this point, the circuit remains in that condition, i.e., with the transformers 120, 122 energized, until the grinding operation is completed, it being noted that the latch relays 94 (FIG. 8) are manually actuated, and after being turned ON, they cannot be turned OFF until the grinding operation is completed, and the circuit is de-energized, preventing accidentally throwing a switch and leaving fewer chucks energized while the grinding operation is proceeding.

Upon completion of the grinding operation, while the apparatus is in ON condition, and it is desired to demagnetize the chuck and workpiece, the switch 28 (108) is turned OFF, which shorts module terminals #6, #9 (65) which applies a charge on the capacitor 136 (65) of 12V. which discharges through a certain period, as explained below, during which the demagnetizing steps are performed.

In this step also, the terminals #1, #12 (103) are opened, enabling the oscillator 100 (95) to operate. This voltage is applied to the terminals #6, #9 (140) and as a consequence the relay 104 (112) is de-energized, and it remains de-energized as long as the charge on the capacitor 136 (65) is discharging or decaying.

In the demagnetizing phase, attention is directed to an adjustable control means 138 (64, 91) made up of two units 138A and 138B. The unit 138A (64) includes a plurality of resistors 140, individually identified 140A, 140B, 140C, arranged in parallel, and associated therewith is a slide 142, movable to different positions for selectively placing one or more of the resistors in circuit. These resistors control the rate of discharge of the capacitor 136.

The control unit 138B (91) includes a plurality of capacitors 144 individually identified 144A, 144B, 144C. These capacitors are arranged in parallel, and associated therewith is a slide 142B ganged with the slide 142A for conjoint manual operation, and movable between different positions indicated to selectively place one or more of the capacitors 144 in circuit.

As a further step in the demagnetizing phase, upon opening terminals #1 and #12 (103), the negative potential is removed from SCR 128 (95), which is then energized and turned ON, and it charges one of the capacitors 144, e.g. 144B (92). This capacitor is charged to a predetermined level, according to the adjustment of a potentiometer 146 (95) and pursuant to that step, positive potential rises above the negative supplied by a zener diode 148 (94) thus turning ON SCR 150 (99). When this SCR 150 is thus energized, it applies negative voltage to SCR 128 (95) and turns it OFF. As the SCR 128 shuts OFF, the capacitor 144B discharges and turns OFF SCR 150 (99) which again allows SCR 128 to turn ON. This is repeated indefinitely until the terminals #1 and #12 (103) are shorted again, in response to the switch 28 being turned ON.

With the terminals #1 and #12 (103) thus shorted, the SCR 128 (95) is OFF. With the capacitor 144B (92) now discharged, positive potential is not present at the gate of transistor 152 (88) which is therefore OFF, and consequently only positive potential is applied to the gate of transistor 154 (88), and when the latter transistor is ON, it turns OFF SCR 156 (82). The gate of SCR 130 (82) is supplied with positive potential from a zener diode 158 (86) and the positive potential for the transistor 154 (88) is supplied from the zener diode 148 (94). When transistor 154 is ON, the transistor 152 is OFF, and vice versa.

Reference is made again to the description above of the operation of SCR 130 (82), and transistor 134 (82) which control the energization of the transformers 120, 122 (77); in a similar manner the SCR 156 (82) when energized and acting through a transformer 160 (82) controls a transistor 162 (82), and this transistor in turn, controls the transformers 124, 126 (75). Thus in response to the transistors 152, 154 (88) alternately turning ON and OFF, the SCR's 130, 156 (82) are correspondingly turned ON and OFF alternately, and thus the transformers 120, 122 at one time, and the transformers 124, 126 at another time, are energized. This alternate energization continues through the period of discharge of the capacitor 136 (65). As this charge diminishes, the voltage applied through the transformers 120, 122–124, 126 and thus to the chuck, through that period, is reduced in successive steps, and pursuant to this reduction of voltage, and the reversals in the successive steps, the magnetism of the chuck is reduced to zero, or nearly so. Upon the complete discharge of the capacitor 136 (65), the voltage at the terminals #6, #9 (140) is also reduced and it disappears, and pursuant thereto, the relay 104 (112) again turns ON, energizing the RED signal light 164 (110) through the contacts **104*e* (110**).

Attention is directed to the control functions of the unit 138 (64, 91). When the slides 142A, 142B are moved conjointly, they are thus moved to the positions indicated S, M, F, or slow, medium, and fast. In the case of the slow position, in 138A, only a single resistor is in circuit, while in the case of the unit 142B in this position, two capacitors are connected, producing a slower buildup to charge and thus a slower functioning step. A similar but opposite situation exists in the fast position, where two resistors 140 are in circuit, while a single capacitor 144 is in circuit.

The overall length of the demagnetizing period can be varied by selecting the resistors in the unit 138A (62) and the number of reversal steps within that period by selecting the capacitors in the unit 138B (91).

I claim:

1. Apparatus for demagnetizing, comprising, chuck means including a plurality of individual chucks, first control means actuatable to energizing and de-energizing positions operative for placing the chucks in circuit and out of circuit, respectively, magnetizing means operable, when energized, for magnetizing the chuck means, demagnetizing means operable, when activated, for demagnetizing the chuck means, second control means actuatable to selectively energize the magnetizing means and the de-magnetizing means, and means preventing movement of the first control means to de-energizing position in response to said second control means being in energizing position.

2. Apparatus according to claim 1 wherein, the first control means constitute a plurality of latch relays actuatable manually to energizing position, and the preventing means includes third control means operable for its stated function by interrupting circuit to the latch relays.

3. Apparatus according to claim 1 and wherein, said first control means are operable for placing any of the chucks in circuit independently of the other chucks, and the apparatus including, means operable for interrupting circuit to the chucks in response to the current to the chucks falling below a predetermined value.

4. Apparatus according to claim 1 including, sensing means operatively associated with the chucks, and including means operable, in response to the current in any of the chucks falling below a predetermined level, for shutting off the chuck means.

* * * * *